US005427328A

United States Patent [19]

Tong et al.

[11] Patent Number: 5,427,328

[45] Date of Patent: Jun. 27, 1995

[54] LASER BEAM RIDER GUIDANCE UTILIZING BEAM QUADRATURE DETECTION

[75] Inventors: Kay C. Tong, Mission Viejo; Richard F. Binns, San Pedro, both of Calif.

[73] Assignee: Northrop Grumman Corporation, Los Angeles, Calif.

[21] Appl. No.: 701,043

[22] Filed: Feb. 12, 1985

[51] Int. Cl.[6] ..... F41G 7/24

[52] U.S. Cl. ..... 244/3.13

[58] Field of Search ..... 244/3.13

[56] References Cited

U.S. PATENT DOCUMENTS

| | | | |
|---|---|---|---|
| 3,690,594 | 9/1972 | Menke | 244/3.13 |
| 4,243,187 | 1/1981 | Esker | 244/3.13 |
| 4,299,360 | 11/1981 | Layton | 244/3.13 |
| 4,408,734 | 10/1983 | Koreicho | 244/3.13 |
| 4,432,511 | 2/1984 | Tong | 244/3.13 |

FOREIGN PATENT DOCUMENTS

| | | | |
|---|---|---|---|
| 2033186 | 5/1980 | United Kingdom | 244/3.13 |

*Primary Examiner*—Charles T. Jordan
*Assistant Examiner*—Theresa M. Wesson
*Attorney, Agent, or Firm*—Terry J. Anderson; Karl J. Hoch, Jr.

[57] ABSTRACT

A beam rider guidance system is presented which uses a rotating laser light pattern to enable a weapon-borne laser receiver to derive its position relative to the beam axis. The guidance beam consists of changing light patterns detected and decoded by the receiver as a guidance code, which defines the unique weapon position in the beam. The code is composed of four distinguishable patterns of light bars which can be detected and decoded into electrical pulses by the laser receiver located anywhere within the confines by the guidance beam.

14 Claims, 4 Drawing Sheets

RECEIVER

LASER BEAM RIDER GUIDANCE UTILIZING BEAM QUADRATURE DETECTION

FIELD OF THE INVENTION

The present invention relates to beam guidance systems for projectiles and the like, and more particularly to a laser beam system which optically generates beam quadrant information for enabling a receiver in the projectile to determine what its position is relative to the beam axis.

BRIEF DESCRIPTION OF THE PRIOR ART

Laser beam rider guidance is a guidance scheme by which a weapon is guided from a launcher to a selected target through a laser optical link. Such a guidance system is an attractive technique due to two primary factors: accuracy and simplicity. It is an effective technique for guiding missiles and other projectiles against targets which are within the line-of-sight of the laser guidance projector associated with the launcher. Generally, a laser beam consisting of modulated light patterns is projected toward the target by a guidance transmitter allowing the rearward facing laser receiver in a weapon to receive and detect the laser light. The received light is decoded and the information derived therefrom is utilized by the receiver to determine the weapon position relative to the beam axis. The exact location of weapons within the beam need not be known to the launcher, since the precise position of the weapon in its flight toward the target is derived by the laser receiver in the weapon.

U.S. Pat. No. 4,432,511, issued Feb. 21, 1984, is directed to a guidance system which comprises a beam projector assembly including a pair of synchronized disks rotating on centers so positioned that an annular pattern of coded reticles on one disk passes vertically through the beam centerline and a similar pattern on the other disk passes horizontally through the beam centerline, adjacent to the first disk. The beam passes through both disks simultaneously, with spaced elevation modulation signals from the coded reticles on one disk alternating with spaced azimuth modulation signals from the coded reticles on the other disk.

In certain positions between the spaced modulation signal reticles, the disks are completely light transmitting, to allow the full cross section of the beam to pass for use as an intensity calibration signal. In certain other remaining reticle positions of the disks, respective on-off beam signals can be projected to serve as digital signals for each of several missiles being guided to different targets at the same time.

Although the older guidance system disclosed in the earlier patent '511 operates satisfactorily, its penetration power is somewhat limited. This becomes a significant limitation in tactical situations where poor weather or pollution limit weapon effectiveness.

BRIEF DESCRIPTION OF THE INVENTION

The present invention is an improvement of the guidance system disclosed in U.S. Pat. No. 4,432,511. Of great significance is the utilization of a stationary continuous wave laser, instead of the pulse laser employed in my earlier patented device. This results in greater laser penetration of the atmosphere.

By virtue of the present invention, a novel beam rider guidance system is presented wherein the guidance beam is not conically scanned in space, but uses a rotating laser light pattern to enable a weapon-borne laser receiver to derive its position relative to the beam axis. The guidance beam consists of changing light patterns detected and decoded by the receiver as a guidance code, which defines the unique weapon position in the beam. The code is composed of four distinguishable patterns of light bars which can be detected and decoded into electrical pulses by the laser receiver located anywhere within the confines of the guidance beam. The scanning light bars which allow the receiver to derive its position may take on the form of bar width, bar spacing, polarization, light intensity or wavelength. The information carrying light patterns are generated by relative motion of a steady light beam passing through a reticle wheel resulting in the modulation of the light beam in definite space and time relationships. In the case of bar width and bar spacing codes, the patterns are generated by transparent and opaque patterns on the reticle wheel in relative motion with the beam which is projected through. The concept of deflecting a steady light beam over different parts of the reticle and then deflecting back into the beam axis of the projector to effect the light modulation is then approached which results in projector packaging advantages. The concept of reticle modulation of a continuous wave laser, such as a continuous $CO_2$ beam allows the use of higher power laser sources presently available without the problems associated with pulsing a laser by electronic means.

In a preferred embodiment a continuous wave laser projects coherent light through an optical disk which nutates about the laser beam axis. The disk is divided into four quadrants, each quadrant characterized by opaque portions, referred to hereinafter as "light bars." The number of light bars in each quadrant is the same and they differ from one another by their angular width. Thus, each quadrant of the disk includes a number of such light bars, equal in number to those in the other quadrants, the light bars in the particular quadrant having a distinctive angular width which identifies that particular quadrant. Due to the relative motion between the laser and the disk, a laser beam projects a coherent beam of light which at any moment in time is referred to as a "light bundle." As the light bundle moves around the disk, it becomes encoded with the light bar information existing on the disk and, as a result, a projection exists between the disk and a projectile receiver. The projection which may be characterized as the locus of light bundles which cyclically projects beam quadrant information for the projectile receiver. Thus, if a guided projectile strays from the beam axis, its receiver will detect more data, relative to the beam quadrant in which it has strayed, thereby enabling the projectile receiver to initiate corrective measures.

Although the laser source for the present invention is a continuous laser, the light bars introduce a pulsing or chopping of the continuous laser beam thereby enabling a projectile receiver to digitally process the laser data it receives. As a result of using a continuous wave laser, the desired greater penetration for guidance may be achieved.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
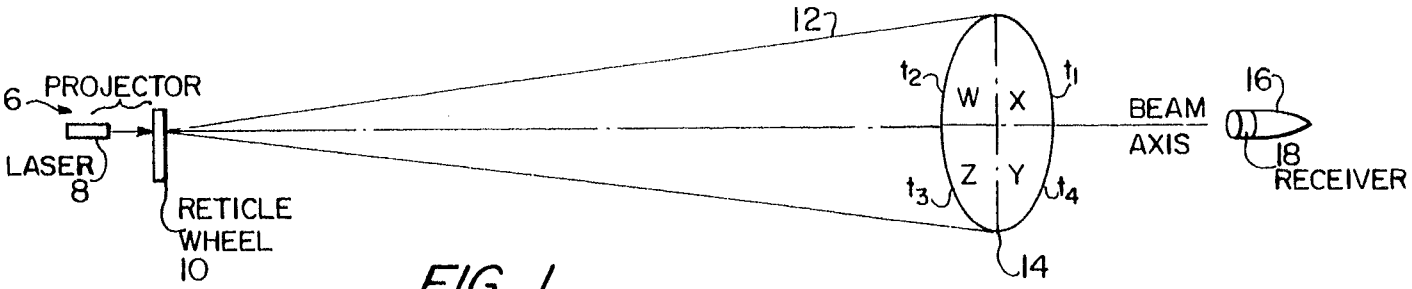
FIG. 1 is a graphical illustration of quadrant designation as employed in a projector of the present invention.

Referring to the figures and more particularly FIG. 1 thereof, an illustration of the present inventive concept is illustrated. A laser 8 projects continuous light through reticle wheel 10 which is characterized by distinctive patterns in quadrants W, X, Y and Z in the nature of light bars previously mentioned. As will be explained in greater detail hereinafter, there occurs nutating motion between the laser light and the reticle wheel so that these two components serve as a projector of beam 12 which has the quadrant information encoded thereon as could be seen through any transverse plane 14 through the beam. The projector 6, at any one instant of time, projects only a part of the pattern on reticle wheel 10, which is referred to as a light bundle. The nutating motion of the laser light relative to reticle wheel 10 generates the quadrant information in beam 12 on a cyclical basis. Thus, during corresponding time intervals $t_1$, $t_2$, $t_3$ and $t_4$, there are corresponding quadrant patterns X, W, Z and Y as a result of the locus of light bundles being projected by projector 6, the light bundles containing corresponding portions of the quadrature data.

A receiver 18 in a projectile 16 views a projected beam and when the projectile 16 is off course from the beam axis, it detects those light bundles projected in the beam quadrant corresponding to the "off-center" position of the projectile. Conventional guidance electronics in the projectile is then able to process this information and correct the course of the projectile.

The projector, at any one instant of time, projects only a part of the pattern on reticle wheel 10. In order to better appreciate this, reference is made to FIG. 2 wherein the pattern on the reticle wheel is clearly shown. As will be observed, the reticle wheel is basically divided into four quadrants, indicated as X, W, Z and Y. These quadrants are defined relative to Axis A and orthogonal Axis B, which may correspond to the axes for azimuth and elevation. Each quadrant has a number of radial segments equally spaced from each other and having the same angular thickness. This angular thickness differs between the various quadrants. Thus, segment 20 in the X quadrant may typically be 8° while in the adjacent Y quadrant segment 22 may have an angular thickness of 6°. Similarly, the segments in the Z quadrant and W quadrant may respectively be 4° and 10° in angular thickness. A central area of circular configuration 26 permits light to pass through the center of the reticle wheel 10 and the radially inward ends of the various light bars are terminated along eight star-shaped, imaginary lines, each drawn between the quadrant points along the circumference of the disk and the two tangential points along the imaginary circumference of circular area 26. The X quadrant and Y quadrant are sharply delineated by the existence of the "blank" area between lines 25 and 24.

At a particular point in time, the part of the reticle pattern being projected by projector 6 may be a bundle of collimated light defined by the circumference of circle 28. At this moment the projected pattern portion includes only those segments existing within the W quadrant. As the laser light nutates, relative to the reticle wheel 10, a subsequent collimated bundle of light may be defined by the circumference of circle 32. In this instance, projected light from reticle wheel 10 will include images of the light bars within the X quadrant. The light bundles defined within the bounds of circles 28 and 32 will have as their center corresponding points 30 and 34. As the laser light nutates with respect to reticle wheel 10, the loci of all light bundles are defined around circle 35. Thus, for one complete nutation cycle, the light pattern in the projected beam undergoes changes on a cyclical basis so that light bar images exist along the projected beam 12 (FIG. 1) thereby enabling projectile receiver 18 to detect its position relative to the axis of beam 12. It is to be pointed out that, although the laser light source 8 is a continuous wave laser source, the guidance information is carried by light pulses generated by light modulation occurring as the continuous wave light encounters the light bars on reticle wheel 10. It is also further noted that, although the lines separating the quadrants, such as 24 and 25, are shown to be straight lines, they need not necessarily be so and may assume other optimized shapes.

Figure 2:
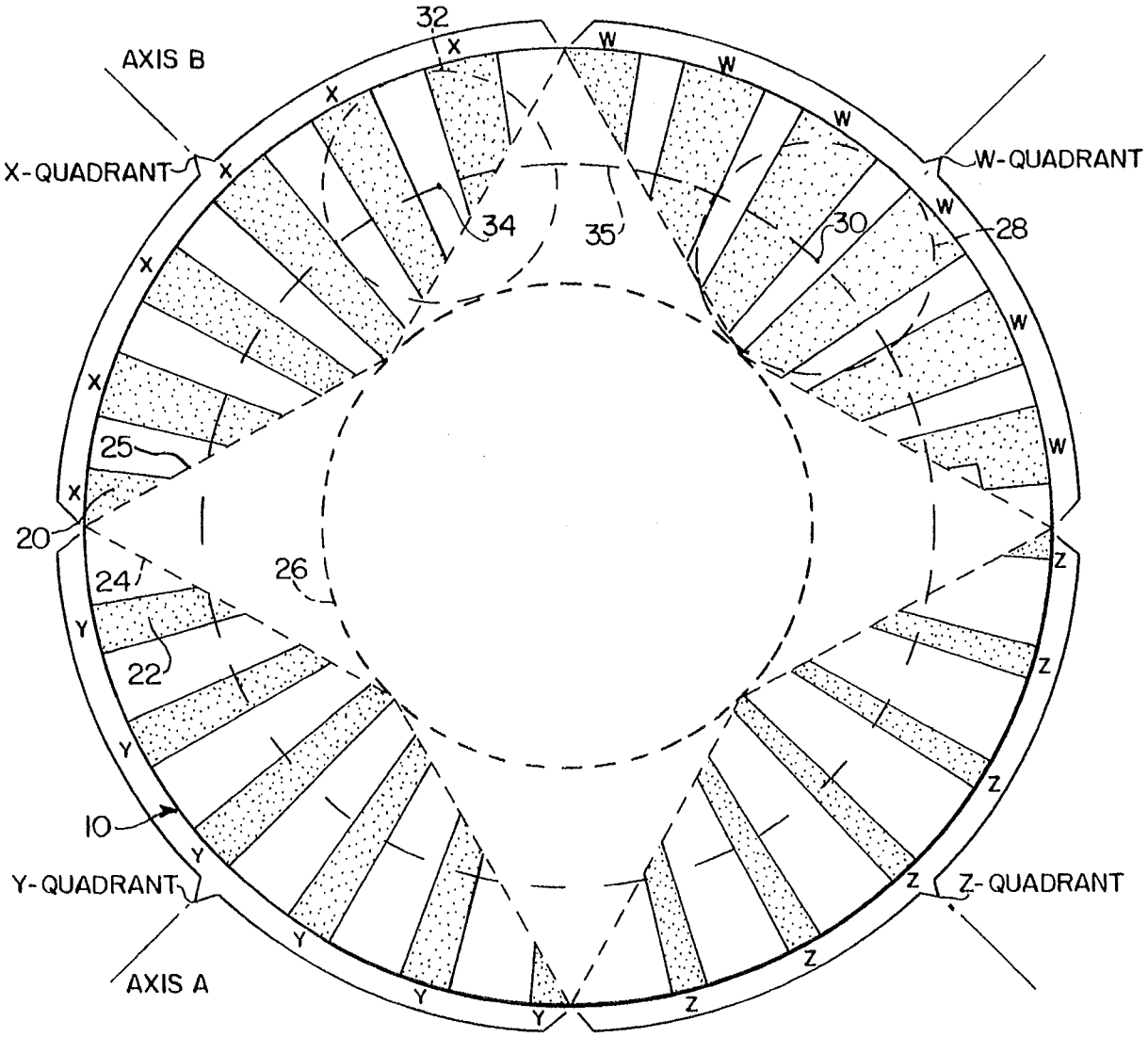
FIG. 2 is a plan view of a simplified optical disk as utilized in conjunction with the present invention.

As previously mentioned, in each quadrant equal numbers of light bars exist. However, as shown in FIG. 2, the lower edges of each light bar are radially staggered due to their intersection with the imaginary star-shaped straight lines. As the projected pattern changes with time due to nutation and after one complete traversal of reticle wheel 10, a weapon receiver looking rearwardly toward the reticle wheel will detect more of the light bars corresponding to the quadrant in which the projectile is located, if the projectile is "off center" relative to the projected beam axis (FIG. 1). For example, the projectile receiver 18 (which is of conventional design) will detect more W quadrant light bars pulses than Y quadrant light bars pulses if the projectile is located in the W quadrant of the projected beam 12. The light pulses detected at the projectile receiver 18 are produced by the relative motion of the opaque light bars crossing the beam.

Likewise, a projectile located in the Z quadrant of the projected beam will detect more Z quadrant light pulses than X light pulses from the other quadrants. Since the number of pulses relative to a particular quadrant increases monotonically with the radius of the reticle wheel, the difference between the number of light pulses between opposite quadrants is a measure of the projectile's radial distance within a particular quadrant of the projected beam 12 (FIG. 1). Thus, for example, the difference between the number of W light pulses and the number of Y light pulses is a measure of a projectile's radial distance within the W quadrant of the projected beam. Similarly, for the X and Z quadrants, a net difference of the X light bar pulses over those of the Z light bar pulses measures the projectile's position in the X quadrant of the beam.

By allowing for multiple complete reticle wheel nutations, the difference in the quadrant pulses detected builds up and gives accurate guidance signals to a weapon control system of conventional design (not shown) connected to the projectile receiver, to steer the projectile toward the projected beam axis. On the projected beam axis, the receiver will detect equal numbers of each of the four quadrant pulses indicating that no further steering commands need be generated.

Figure 3:
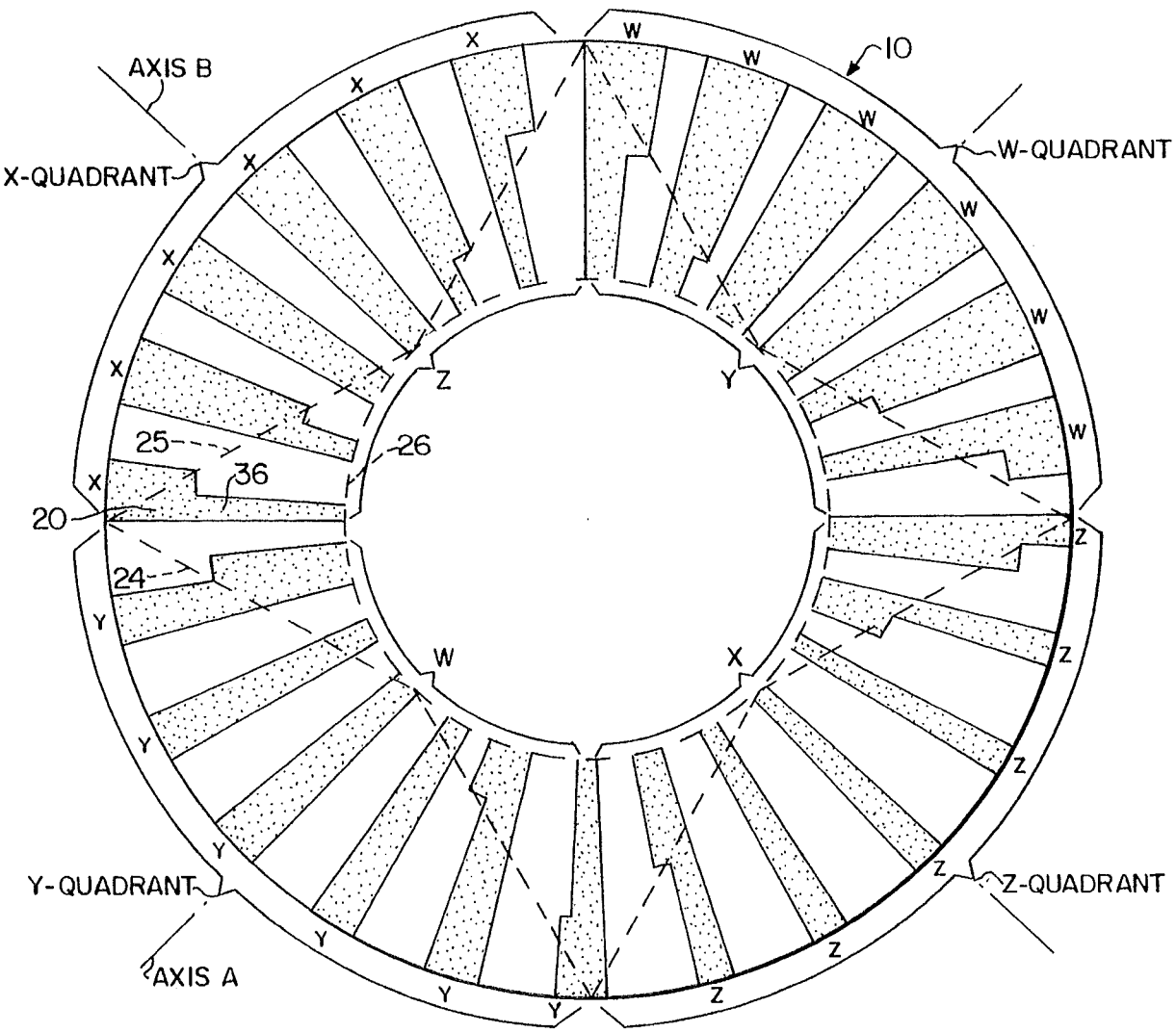
FIG. 3 is a view of a disk, similar to that of FIG. 2, but supplemented with complementary quadrants for maximizing the data generation capabilities of the disk.

FIG. 3 illustrates an embellishment of the light bar pattern previously discussed in connection with FIG. 2. Particularly, the light bar patterns have been extended into to the previously blank area existing between the eight imaginary star-shaped straight line segments. Thus, light bar extensions such as 36 are included between the imaginary straight lines 24 and 25. It is to be noted in FIG. 3 that each of the previously discussed light bars has its own respective light bar pattern extensions. In order to increase the rate of data flow, it is desirable to include these light bar extensions within the space which was previously blank and these light bar extensions define complementary quadrants. Thus, as will be observed, the radially outward quadrants X, W, Z and Y have radially inward corresponding complementary quadrants Z, Y, X and W.

The receiver 18 shown in FIG. 1 includes processing circuitry to be discussed in connection with FIG. 5. Briefly, in that weapon receiver the quadrant light bars are detected and counted over a given time period. For the orientation of the reticle wheel shown in FIG. 3, the guidance signals are generated based on the following relations:

Up Signal $=(W+X)-(Y+Z)$

Down Signal $=(Y+Z)-(W+X)$

Right Signal $=(W+Z)-(X+Y)$

Left Signal $=(X+Y)-(W+Z)$ where W, X, Y and Z in these relations represent the time interval counts of the quadrant light bars W, X, Y and Z, respectively. The cumulated count for any of the light bars W, X, Y and Z include those in the primary quadrants along the outer circumference of the reticle wheel as well as those of the complementary quadrants.

To increase the word resolution, i.e., decreasing the incremental difference between the light bar counts, the reticle wheel may be made to jitter slightly in its position with a systematic relationship to the circular light bundle nutation movements at a rate slower than the nutation rate. By this scheme the guidance resolution is increased at a reduced data rate.

It is to be noted that the light bar patterns on the reticle wheel in FIG. 3 are tapered to converge toward the center of the wheel. This is made to ensure that the time required for the weapon receiver to traverse a light bar is a constant regardless of the receiver's position in the projected beam.

The basic concept of the present invention is to produce relative nutation motion of light bundles with the different sections of the reticle wheel pattern. This nutation motion is not the same as that produced by spinning the reticle wheel about its axis while projecting a laser light bundle through it. The desired modulation may be produced by keeping the light bundle stationary while moving the axis of the reticle wheel circularly around the light bundle without changing the orientation of the reticle wheel i.e., a translation along circular path 35, without rotation. Alternately, the desired light bundle may be made to deflect into the different areas of the reticle wheel in a circular motion while keeping the reticle wheel stationary. In either case, a relative nutation motion between the light bundle and the reticle wheel is produced.

Figure 4:
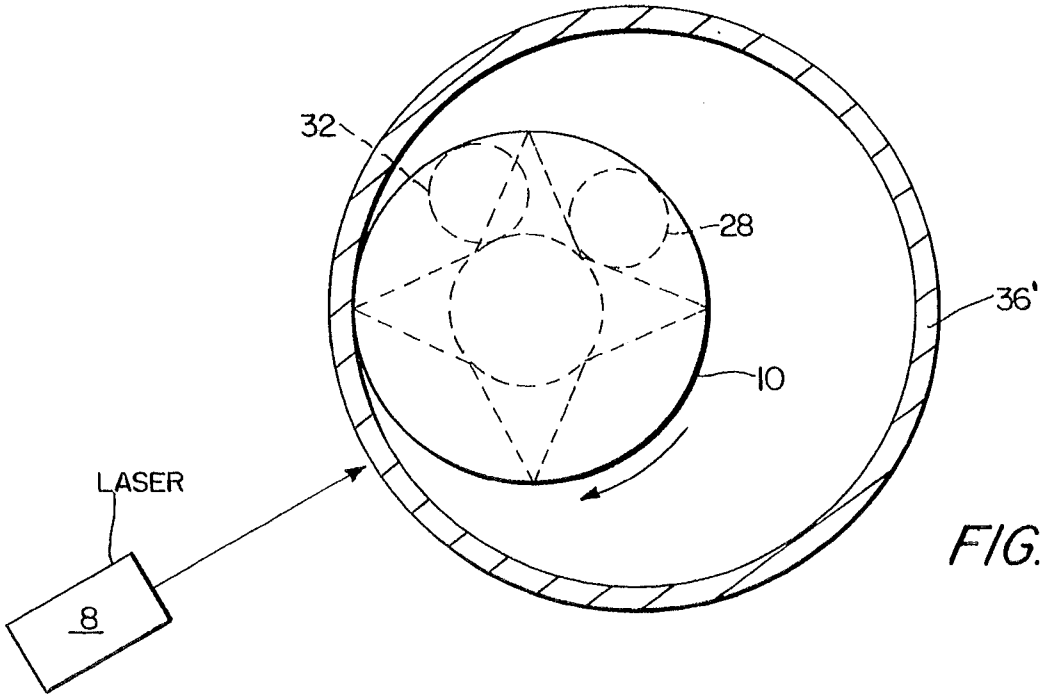
FIG. 4 is a diagrammatic view of the present invention illustrating the relative position of a laser and an optical disk for projecting light bundles, in the direction of a projectile receiver, which bundles include quadrant information for achieving projectile guidance.

The former approach is illustrated in a basic form in FIG. 4. A planetary track 36' is positioned in a plane perpendicular to the rays of light generated by laser 8. A reticle wheel 10 is located inwardly of track 36' and undergoes planetary motion therearound whereby nutating motion of the wheel is achieved. The planetary motion between reticle wheel 10 and track 36' may be achieved by belt drive, gear drive or other prior art planetary driving means. It is important that the light from laser 8 always hits reticle wheel 10.

Figure 5:
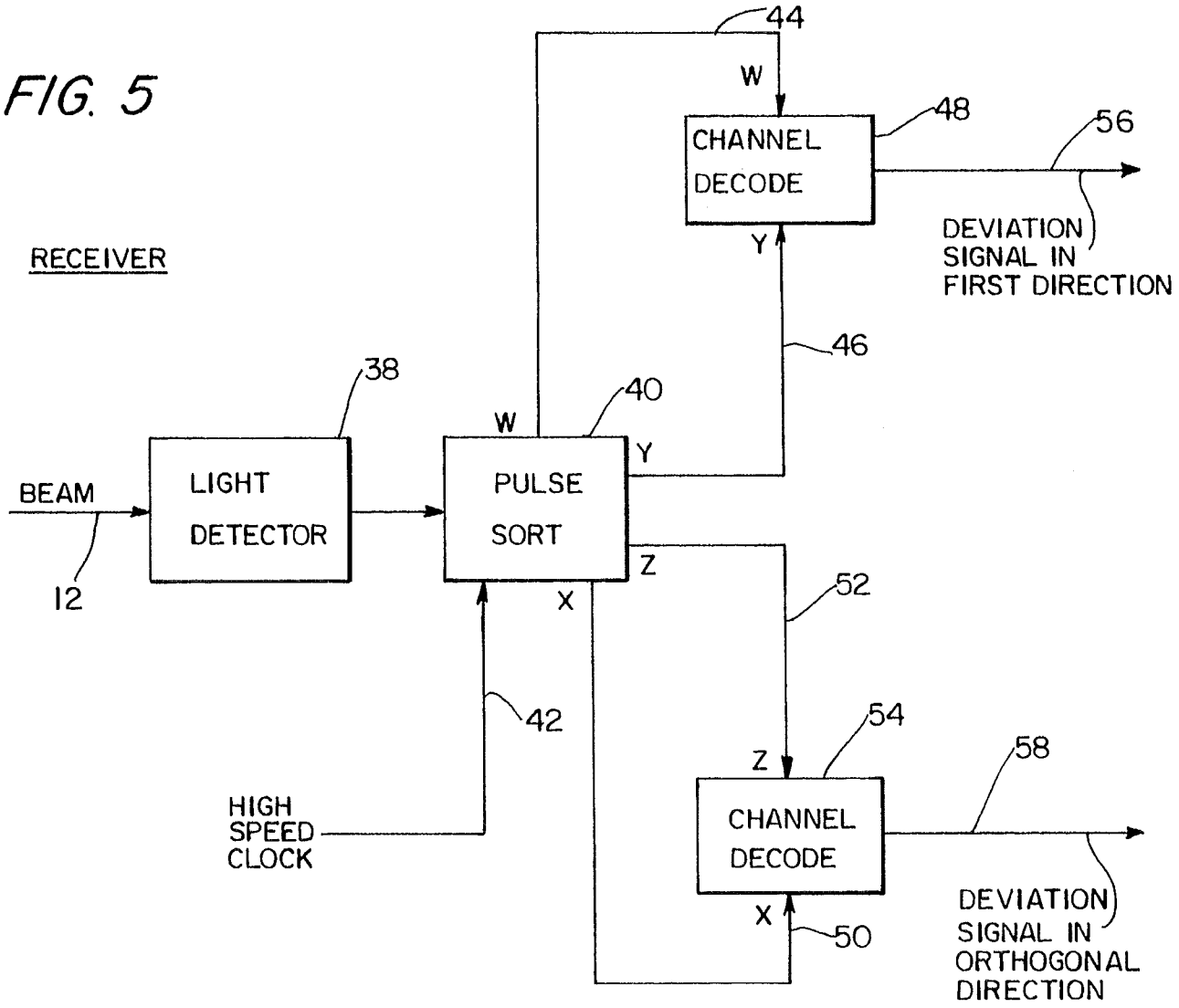
FIG. 5 is a block diagram of a receiver which may be utilized in a projectile, in accordance with the present invention.

FIG. 5 is an illustration of a basic receiver processor for processing guidance signals received from the encoded beam projected through reticle wheel 10. As previously mentioned in connection with FIG. 2, the light bars in the primary and complementary quadrants have respectively distinctive angular thicknesses. Inasmuch as the light bundles nutate about the reticle wheel 10 at a constant rotational speed, the angular thicknesses of the respective light bars will translate into corresponding pulse durations. A pulse sorter 40 in the nature of a conventional pulse timer counts the time duration between the leading and trailing edge of each pulse received from light detector 38. Depending upon the time interval, the received pulse is counted or sorted as a W, Y, Z or X pulse. The pulse sorter 40 is synchronized by a high speed clock at input line 42. The channel decoder 48 receives the W and Y outputs from pulse sorter 40 along decoder inputs 44 and 46. In order to determine the missile deviation, for example azimuth, the decoder subtracts the accumulated time intervals for the Y pulses from the W pulses; and the result of the subtraction is indicative of the direction of missile deviation from the beam 12 (FIG. 1). A second channel decoder 54 is provided with inputs 50 and 52 for the sorted X and Z related light bars. Output line 56 makes available a deviation signal in a first direction while output line 58 makes available a deviation signal in the orthogonal direction.

It should be understood that the invention is not limited to the exact details of construction shown and described herein for obvious modifications will occur to persons skilled in the art.

We claim:

1. A projectile guidance system comprising:

a source of continuous coherent light for generating a light bundle travelling along an axis;

a disk having a preselected pattern of radial light bars thereon arranged in sets of differing angular width for modulating a light bundle from the source which is projected through the disk;

means for moving the disk so that the light bundle traverses along a circular path through the sets of radial light bars relative to the disk, whereby a modulated beam is projected into space from the disk and along said axis; and optical receiving means mounted on a projectile for detecting the modulated beam and determining the projectile's position relative to the axis of the projected beam.

2. The system set forth in claim 1 wherein the preselected pattern comprises at least four sets of radial light bars respectively defining four primary quadrants of the beam.

3. The system set forth in claim 2 wherein the light bars of each set are characterized as angular segments having the same angular width, but wherein the angular width of the light bars in any set is different from those in another set.

4. The system set forth in claim 2 wherein the four sets of light bars are mutually separated by symmetrically positioned blank spaces.

5. The system set forth in claim 4 wherein the blank spaces are filled with four sets of radial light bars respectively defining four complementary quadrants of the beam, each set of such light bars being located as a geometric complement of a set in the primary quadrants.

6. The system set forth in claim 5 wherein the four complementary sets of light bars are characterized as angular segments, those of each set having the same angular width, but wherein the angular width of the light bars in any complementary set is different from those in another complementary set.

7. A beam riding guidance system comprising:

a continuous wave laser which generates a light bundle travelling along an axis;

a reticle wheel undergoing motion relative to the light bundle and having a pattern of radial light bars thereon arranged in sets of different angular width for pulse modulating the light bundle as it passes through the wheel thereby creating a beam which projects the pattern into space as time changing modulation along said axis; means for moving the wheel so that the light bundle traverses along a circular path through the sets of radial light bars relative to the wheel; and receiver means mounted on a projectile for detecting the modulated beam and determining the projectile's position relative to an axis of the projected beam.

8. The system set forth in claim 7 wherein the pattern comprises four sets of radial light bars respectively defining four primary quadrants of the beam, the light bars of each set characterized by angular segments having the same angular width, but wherein the angular width of the light bars in any set is different from those in the other sets.

9. The system set forth in claim 8 wherein the four sets of light bars are mutually separated by symmetrically positioned blank spaces and further wherein the blank spaces are filled with four sets of radial light bars respectively defining four complementary sets of the beam, each set of such light bars being located as a geometric complement of a set in the primary quadrants.

10. The system set forth in claim 9 wherein the four complementary sets of light bars are characterized as angular segments, those of each set having the same angular width, but wherein the angular width of the light bars in any complementary set is different from those in another complementary quadrant.

11. The system set forth in claim 10 wherein the receiver means comprises:

means for detecting the projected beam;

means connected to the detecting means for sorting detected pulses in the beam as a function of a quadrant with which they are associated; and decoding means connected to the output of the sorting means for generating two signals respectively indicative of projectile deviation along two orthogonal axes.

12. The system set forth in claim 7 together with means connected to the wheel for imposing jitter thereon which increases pattern resolution and guidance accuracy.

13. A method for guiding a projectile comprising the following steps:

generating a continuous wave light bundle from a laser;

nutating the light bundle relative to a disk, which is characterized by a pattern of transmissive and opaque light bars arranged in four sets respectively defining four primary quadrants of the beam, resulting in a projected beam bearing modulated light corresponding to the pattern on the disk;

detecting the modulated beam at any point within the confines of the beam; and sorting pulses from the detected beam to derive first and second deviation signals corresponding to the deviation of the point from the beam axis along orthogonal axes.

14. A method for guiding a projectile comprising the steps of:

generating a continuous wave light bundle from a laser;

providing a disk which is characterized by a pattern of transmissive and opaque radial light bars arranged in sets about a circular path in the disk, said pattern changing as a function of the angular position and radial distance from the axis moving the disk so that the light bundle traverses along said circular path without rotation resulting in a projected beam stationary with respect to said axis and bearing time modulated light corresponding to the changing pattern the beam encounters as it transverses said circular path on the disk;

detecting the modulated beam at any point within the confines of the beam; and sorting pulses from the detected beam to derive at least first and second deviation signals corresponding to the deviation of the point of reception from the beam axis.

* * * * *